US005465546A

United States Patent [19]

Buse

[11] Patent Number: 5,465,546

[45] Date of Patent: Nov. 14, 1995

[54] PORTABLE DANCE FLOOR

[76] Inventor: Dale C. Buse, 12880 Erin Dr., Auburn, Calif. 95603

[21] Appl. No.: 238,755

[22] Filed: May 4, 1994

[51] Int. Cl.[6] ..... E04F 15/024

[52] U.S. Cl. ..... 52/480; 52/127.11; 52/263; 52/506.09; 52/586.1

[58] Field of Search ..... 52/263, 506.09, 52/506.01, 586.1, 177, 480, 390, 385, 126.6, 403.1, 127.7, 127.11; 472/92

[56] References Cited

U.S. PATENT DOCUMENTS

| | | | |
|---|---|---|---|
| 3,310,919 | 3/1967 | Bue et al. | 52/127.11 |
| 3,425,179 | 2/1969 | Haroldson et al. | 52/263 X |
| 3,470,663 | 10/1969 | Tate | 52/126.6 |
| 3,802,144 | 4/1974 | Spica | 52/177 X |
| 4,051,642 | 10/1977 | Terry | 52/263 X |
| 4,441,293 | 4/1984 | McQueen et al. | 52/586.1 X |
| 4,625,491 | 12/1986 | Gibson | 52/126.6 X |
| 4,635,425 | 1/1987 | Cova | 52/480 |
| 4,642,946 | 2/1987 | Koch | 52/126.6 X |
| 4,744,194 | 5/1988 | Yasuyoshi | 52/506.09 X |
| 4,955,276 | 9/1990 | Feldman et al. | 84/403 |
| 5,033,241 | 7/1991 | Max | 52/385 X |
| 5,052,157 | 10/1991 | Ducroux et al. | 52/126.6 |
| 5,113,632 | 5/1992 | Hanson | 52/385 |
| 5,117,596 | 7/1992 | Leslie et al. | 52/126.6 |
| 5,179,812 | 1/1993 | Hill | 52/480 X |
| 5,303,526 | 4/1994 | Niese | 52/480 X |

FOREIGN PATENT DOCUMENTS

| | | | |
|---|---|---|---|
| 854940 | 11/1970 | Canada | 52/263 |
| 1014419 | 8/1952 | France | 472/92 |
| 3114590 | 10/1982 | Germany | 52/126.6 |
| 1266963 | 3/1972 | United Kingdom | 52/126.6 |

*Primary Examiner*—Carl D. Friedman
*Assistant Examiner*—Laura A. Saladino
*Attorney, Agent, or Firm*—Mark C. Jacobs

[57] ABSTRACT

A portable dance floor formed from the interconnection and interlocking of multiple dance sections each of which dance sections is formed from a dance substrate generally of plywood, wherein each dance section is supported off the ground. Dance sections interlock at the junction of four such sections, on the underside thereof into a main connector plate, and which sections interconnect along the interfacing sides of any two abutting sections by a spline disposed in a slot formed of aligned half slots. Transition members having an inclined plane to ease the change in elevation may be provided and may be interconnected in a similar manner to adjacent dance sections.

16 Claims, 6 Drawing Sheets

PORTABLE DANCE FLOOR

FIELD OF THE INVENTION

This application pertains to portable dance floors, their mode of construction, utilization and disassembly, and, specifically, to one having interlocking and interconnecting dance sections.

BACKGROUND OF THE INVENTION

Portable dance floors have been known in the art since probably back in the dance crazy 1920s. The biggest problems associated with such structures include; (1) the lack of give or resiliency in the floor thereby contributing heavily to tired feet of the dancers; (2) the time necessary to assemble and disassembly the apparatus; (3) the mode of assembly commonly utilized often fails after 10 or 12 put ups and take downs.

It is an object therefore of this invention to provide an improved portable dance floor.

It is another object to provide a dance floor apparatus that employs no screws or bolts for assembly.

It is yet another object to provide a portable dance floor of an infinite number of sections.

It is a further object to provide a portable dance floor composed of a plurality of floor sections each of which provides ample give or resiliency to thereby simulate the dance ability of a professional dance floor.

It is a still further object to provide a dance floor that can be easily and quickly disassembled, due to its unique mode of construction and assembly.

It is an additional object to provide a dance floor whose sections interlock both at the corner of 4 adjoining sections, as well as at the interface of two adjacent sections.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following in detailed description, taken conjunction with the accompanying drawings.

SUMMARY OF THE INVENTION

A portable dance floor of multiple dance sections is provided, which sections are supported off the ground, and which interlock at the junction of four such sections, on the underside thereof into a main connector plate, and which sections interconnect along the interfacing sides of any two abutting sections.

DESCRIPTION OF THE PREFERRED EMBODIMENT

Figure 1:
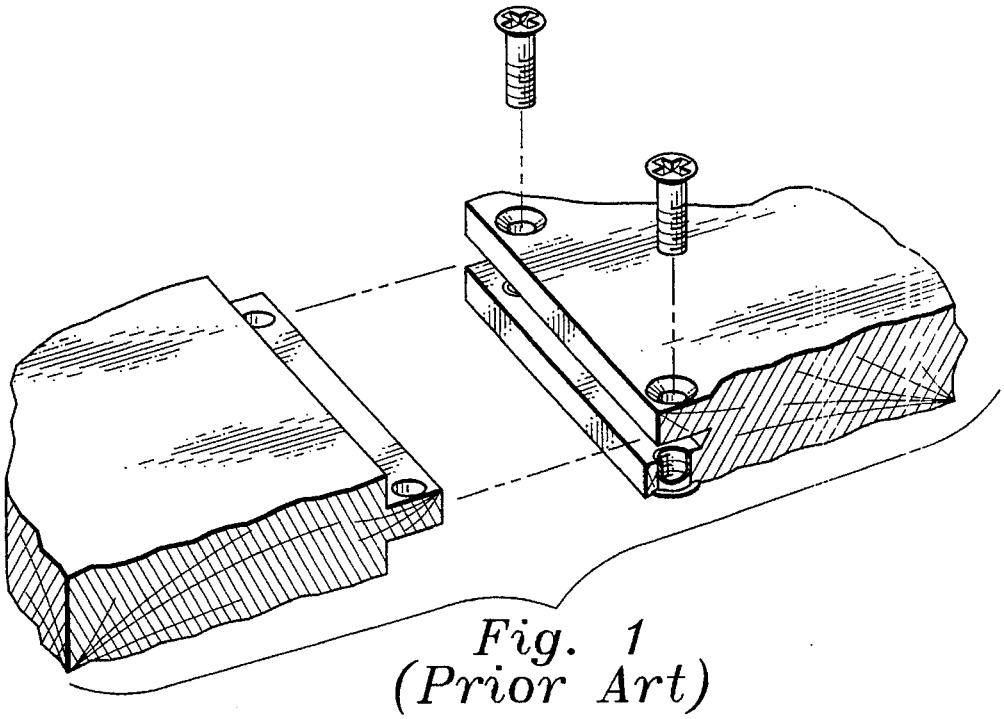
Fig. 1 (Prior Art)
FIG. 1 is a perspective view illustrating the most common mode of assembly of prior art portable dance floors; namely, bolted tongue and groove construction.

Reference is first made to FIG. 1 which illustrates the conventional mode of assembly of portable dance floors comprised of a plurality of dance sections. The most common mode of joining dance sections is to employ a tongue and groove interface of abutting sections, which are then further joined by the use of removable bolts through the groove former and the tongue that fits into the groove. Oftentimes, the groove formers are made of preformed butt mounted metal castings to permit multiple connections and disassembles. See FIG. 1.

The portable dance floor of this invention is comprised of a plurality of generally 4 ft. by 8 ft. dance sections formed of a dance substrate having a dance surface and an underside. Each of these dance sections are both interlocked at the corners of their respective bases, and interconnected to each of the abutting dance sections along preferably the shorter dimension edge. Each dance section is formed preferably of a sheet of plywood supported in the manner to be disclosed herein. Preferably the uppermost ply or dance surface of such plywood is made oak or maple because of hardness.

Figure 2:
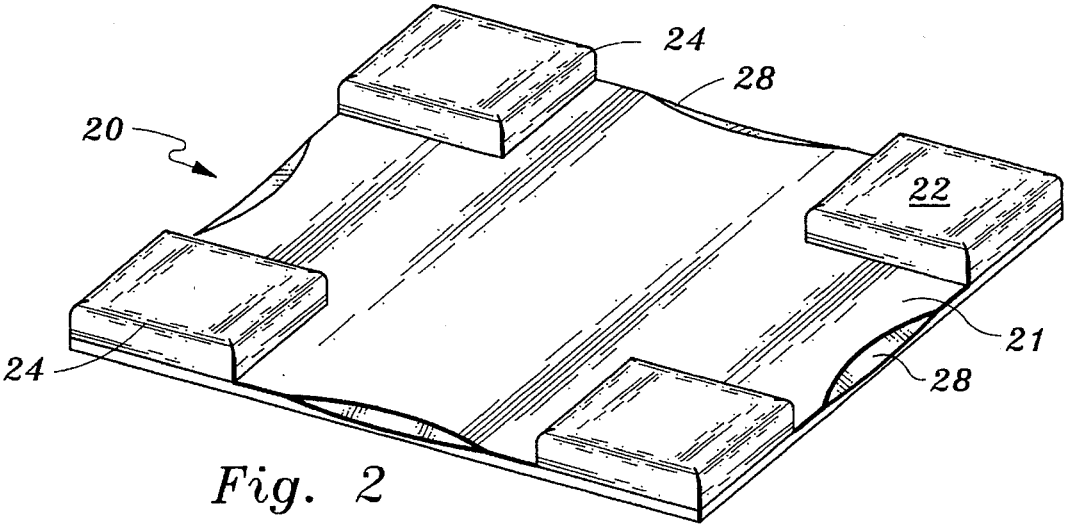
FIG. 2 is a perspective view of the main connector block forming part of this invention.
Figure 5:
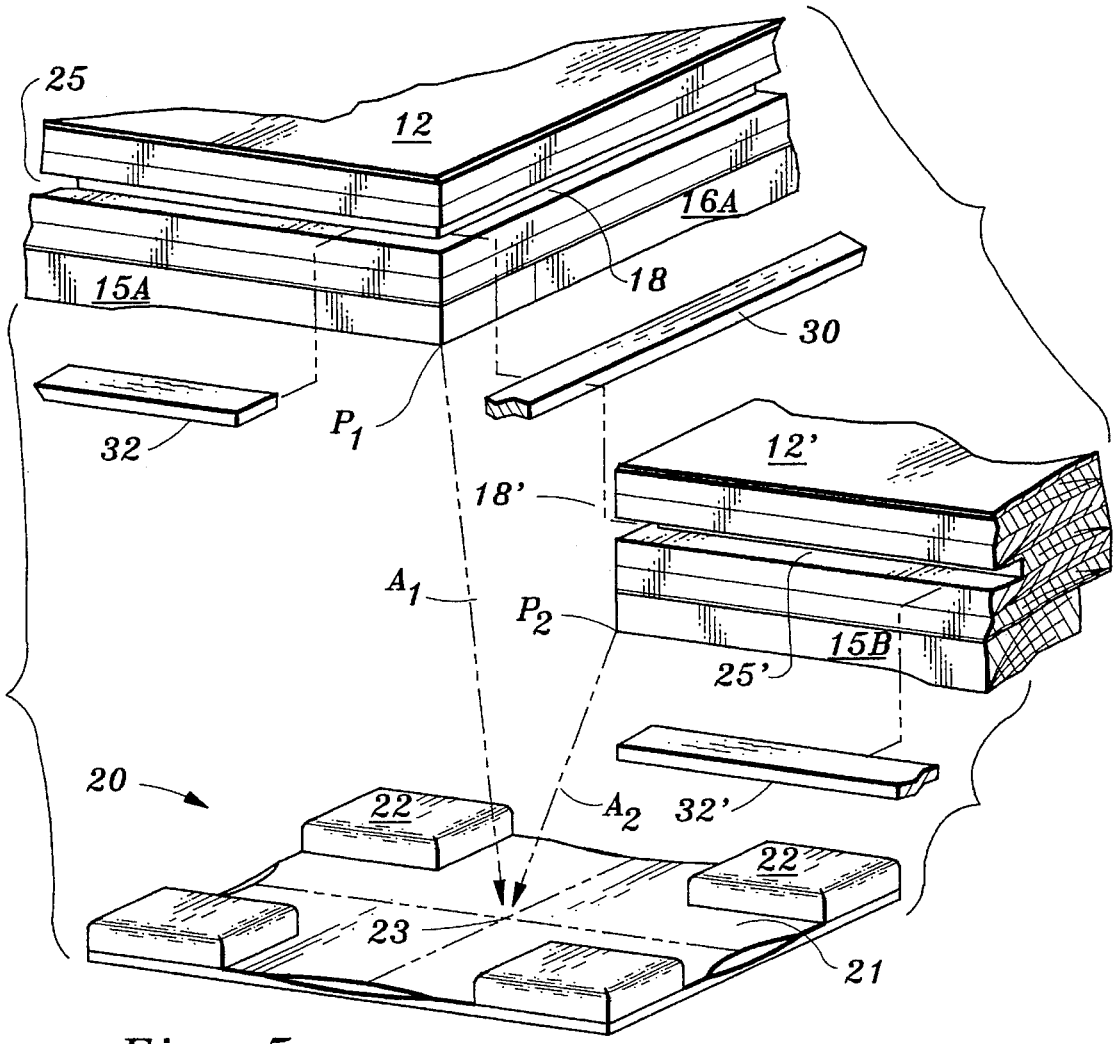
FIG. 5 is an exploded view that illustrates how two adjacent dance sections interlock at one corner.

In FIG. 2 there is depicted one of the modes of junction of the dance sections utilized in this invention. This element 20, designated a main connector plate, is placed at the junction of four dance sections 12. Main connector plate 20 includes a square base, 21, preferably about 7" long and about 1/16th to 1/8th inch thick, upon which a corner block 22 is mounted in upstanding position, on each of the four corners, with space in between. Each block 22 preferably has a filet or a chamfer, 24 along its upper edge to facilitate positioning for utilization in the mode to be discussed infra. Center point 23 seen in FIG. 5 is the locus of the junction of four adjacent dance sections. The main connector plate 20 also includes an edge notch 28 between each upstanding block 22. The purpose of these notches is to render utilization of the tool shown in FIG. 13 a bit easier by providing a caming surface for the operation of said tool.

Figure 7:
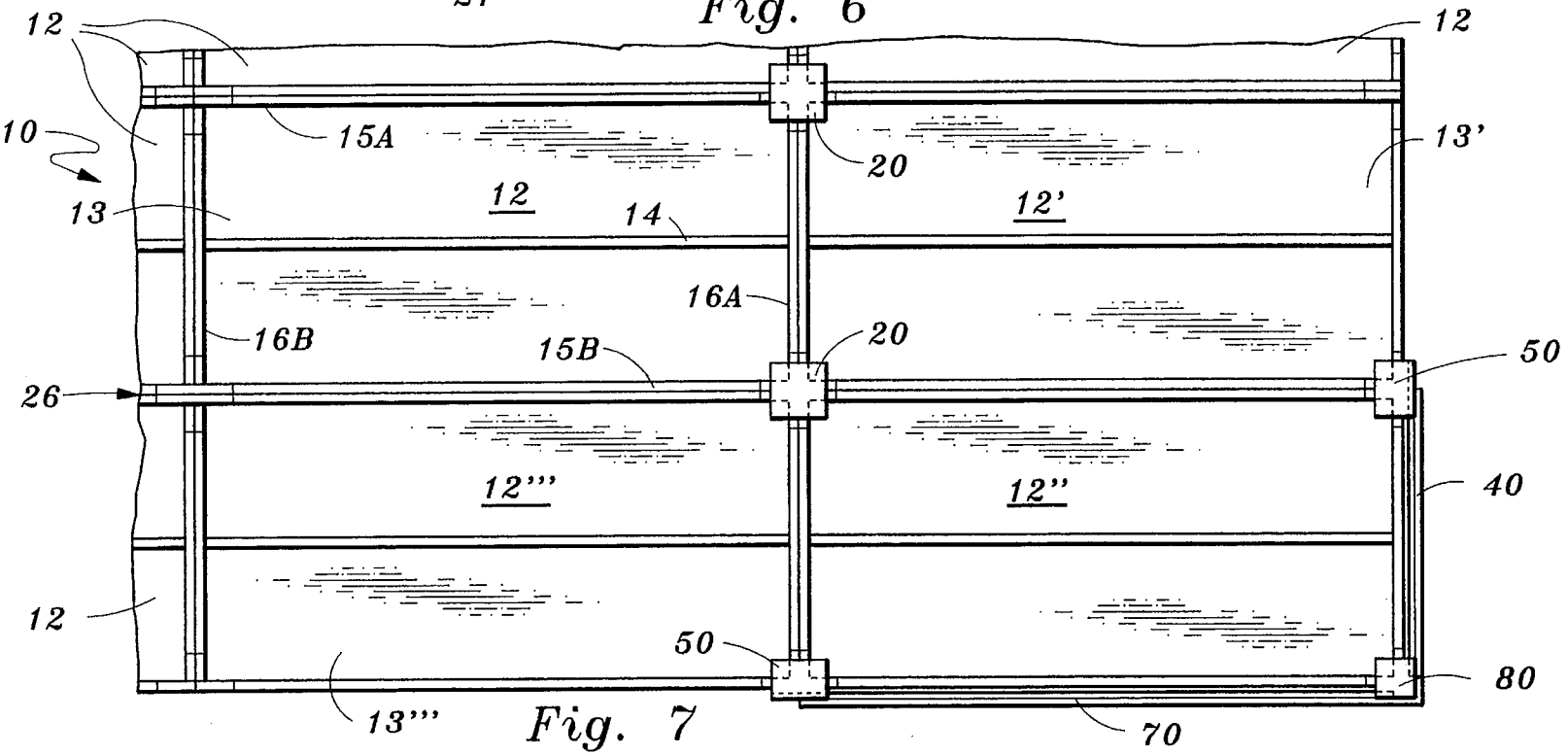
FIG. 7 is a bottom plan view showing the interlocking of four dance sections.

Reference is now made to FIG. 7. This figure depicts a bottom plan view of a dance floor according to this invention but showing only one of the transitions to the ground level, which transitions 40 will be discussed in connection with FIGS. 9 and 10. The dance floor, i.e., the invention 10, is seen to comprise a plurality of dance sections 12. Here four dance sections designated 12, 12', 12", and 12''' are shown adjoined into a dance floor. Since each dance section is the exact same, only the one designated 12 will be described in detail.

Figure 3:
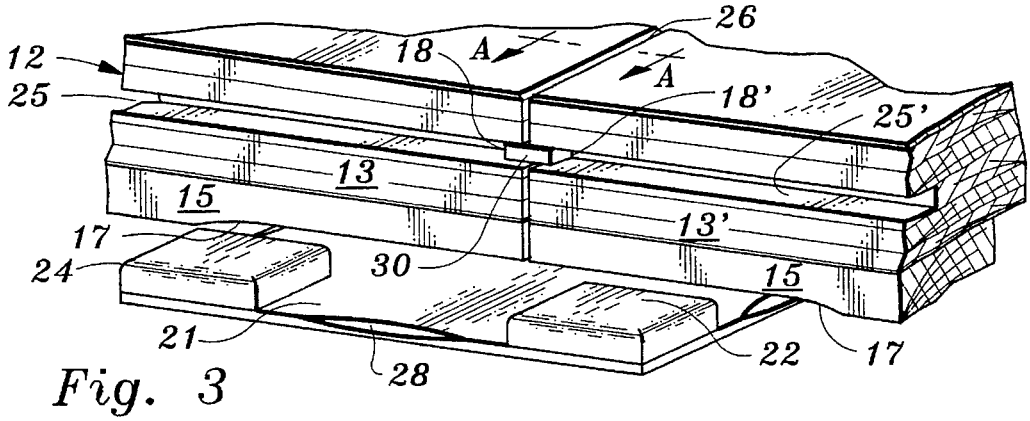
FIG. 3 is a top perspective view illustrating the two modes of interlocking of two adjacent dance floor sections.
Figure 6:
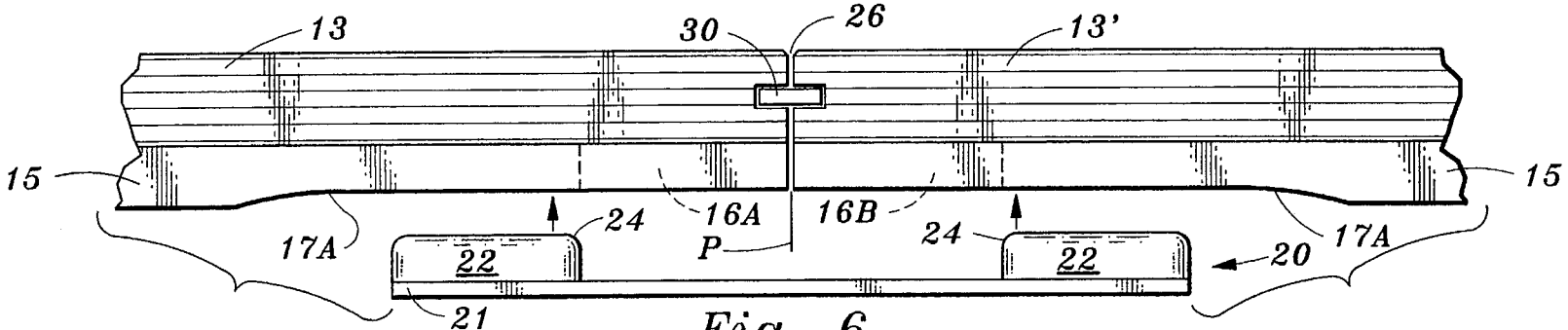
FIG. 6 is a detailed elevational view of the interlocking of two adjacent dance sections.
Figure 11:
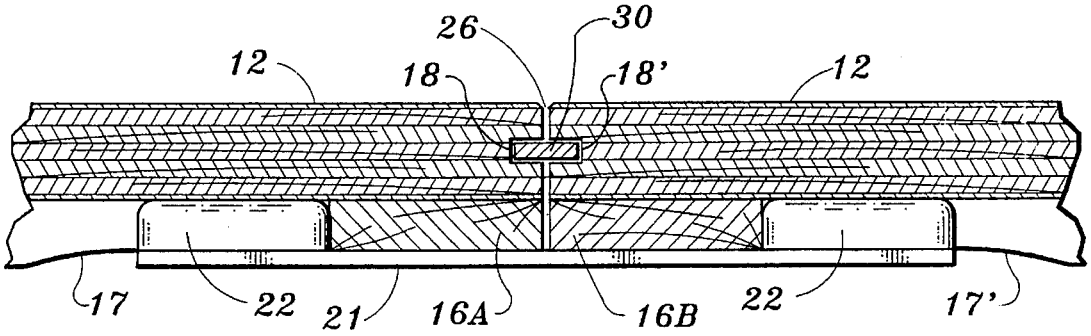
FIG. 11 is a closeup sectional view illustrating the interconnection of a dance section with a main connector block.

Dance section 12 comprises preferably a plywood sheet, 13, usually of a thickness between ½" and 1.0" thick, and of a standard width and length, such as 4 ft.×8 ft. On the under side of the plywood sheet there is preferably disposed along the greater central axis a reinforcing strip 14, of about ½" elevation and between 1.5 and 2.0 inches wide. Build-up strips, 15 of about 8' in length and 16 of about 4' in length, and in some views designated as 15A, 15B and 16A, 16B, each pair being of similar dimensions are disposed around the periphery of the underside of the plywood sheet. As seen in FIG. 3, each build-up strip 15 (and each build-up strip 16 as well, though not separately discussed) comprises an elongated generally rectangular portion having a bottom cutout section 17 at each terminus. Each cutout 17 is of an elevation equal to the base 21 of the main connector plate 20. The longitudinal extent of each cutout 17 is slightly greater than ½ the width or ½ the length of the main connector plate. See also FIGS. 6 and 11.

Portable dance floor 10 as seen in FIG. 7 includes a plurality, here 4 of the dance sections, 12, joined by a main connector plate 20 at the point of junction of the four individual dance sections and transition members at the outer edges along two or four sides as may be desired. For ease and simplicity of the drawing figure, only one transition member 40 is shown here in the lower right corner of FIG. 7, where it is seen from the underside connected to a transition connector plate 50. Note that the transition connector plate 50 does not require the edge notch 28, found in the main connector plate, but its presence is not detrimental.

Figure 12:
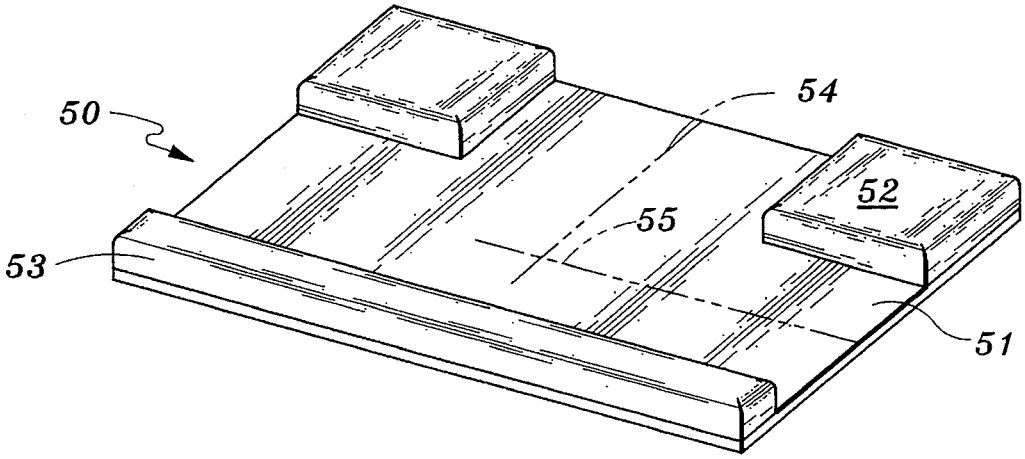
FIG. 12 is a perspective view of a transition connector.

Also shown in FIG. 7 are a pair of transition connector plates, 50, seen in more detail in FIG. 12. These transition connector plates and their use will be discussed in connection with FIGS. 9 and 10.

FIG. 3 offers further explanation of the junction of two abutting dance sections. Each dance section 12 as previously noted includes a plywood sheet 13 supported by a build-up strip around the periphery. Adjacent sheets are designated as 13', 13" for ease of understanding.

Any type of plywood may be employed, even those having an inlaid top surface of parquet wood strips. Typically oak and maple are recommended at least for the uppermost ply of the plywood sheet. Optionally a V-groove 26 may be formed between the junction of two abutting dance surfaces, usually plywood sheets 12. Such a groove may be about a ¼ inch wide by about a ¼ inch deep. The groove is formed by applying a downwardly and outwardly chamfer to each external upper edge of the plywood sheet. The optional V-groove helps to simplify disassembly of the completed dance floor at the end of an evening's use.

Baltic birch is the preferred wood for the build-up strip. Other woods such as oak, and even plastics such as polyurethane elastomer may be employed as the build-up material.

Figure 4:
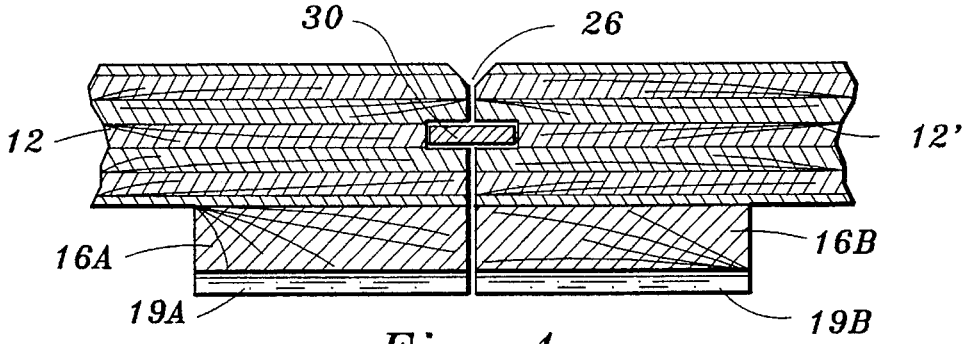
FIG. 4 is a top perspective view taken along the sectional line A—A of FIG. 3.

FIG. 4 also shows the presence of horizontal half slot 18 in plywood sheet 13 and aligned half slot 18' in sheet 13' to form a slot. See also FIG. 11. Each of these half slots are slightly greater than ½ the width of the spline 30, formed of metal bar stock, which is used to interconnect any two abutting dance sections together in both directions, i.e., width and length. While the reinforcing strip preferably runs the length of the plywood sheet, it is suggested that the half slots 18, 18' et cetera be formed along and within the both of the longer and the shorter dimension of the plywood sheet, but at least along the long dimension interfaces. See FIG. 5 which illustrates the two directional utilization. This interconnection by the spline 30 prevents one abutting edge from rising to a slightly higher elevation than its abutting neighbor.

In FIG. 5, the slot defined as above along the shorter or usually 4 foot dimension are designated 25 and 25' respectively, while the spline that fits therein is designated 32.

A typical spline may be formed from ⅛"×½" aluminum or steel rod stock. Proper lengths can be easily cut with a hacksaw or suitable power saw. Since the splines are preferably used in both directions, they are usually cut about 1.5 inches short of the full extent of the direction in which they are to be employed. Thus two adjacent 8 foot long boards have a spline 7 ft. 10.5 in. between them.

In order to ensure that the build-up area of each dance section can be positioned flat on the ground, each strip running both the length and width on the underside of the plywood sheet 13 is cutout at location 17 an amount equal to the height of the base 21 of main connector plate 20. Transition connectors 50 are constructed with a base having a similar elevation, usually ⅛th inch for the same reasons.

FIG. 4 is a view taken along line A—A of FIG. 3. The purpose of this figure is to illustrate the presence the buildup strips along the underside of the shorter dimension of the plywood sheet. Thus one notes short build-up strips 16A and 16B on adjacent plywood sheets 12, 12', which strips have cutaway areas 19A and 19B respectively of the size, i.e., about 3 and 3/16" long and ⅛th inch high, and of the same configuration as cutaways 17A and 17B seen in FIG. 6 and elsewhere. Groove 26 is also visible in this figure, as are slots 18A, and 18B.

FIG. 5 illustrates the interlocking placement of two dance sections 12 and 12' onto a main connector block 20. It is seen from the location of directional arrows A1 and A2, that the blocks 22 each fit interiorly of the two build-up strips 15, 16. When proper placement of the dance sections 12, 12' is achieved, corner points P1, P2 will be just above the center point 23 of the main connector plate 20. Once down, movement of each dance section is impeded by the presence of the respective block 22 which is preferably ⅜th" high held back by the two build-up strips which are ½" high with ⅛th inch thereof being the cutaway. See FIG. 6. The two other dance sections not shown would also meet the two dance sections shown, at point 23 to yield an interlocked dance floor.

Of course we have illustrated only the interlocking of one group of four dance sections. If the dance floor were formed of more of such sections, they would be joined in like fashion using additional main connectors, and additional splines.

While it has been recommended that the reinforcement strips run along the long dimension of each dance section, and that each spline be inserted into a slot 18 along the shorter dimension of such dance section, a reverse construction is also within the scope of this invention, such that the spline runs along the long dimension and the reinforcement strip runs along the shorter dimension.

Figure 8:
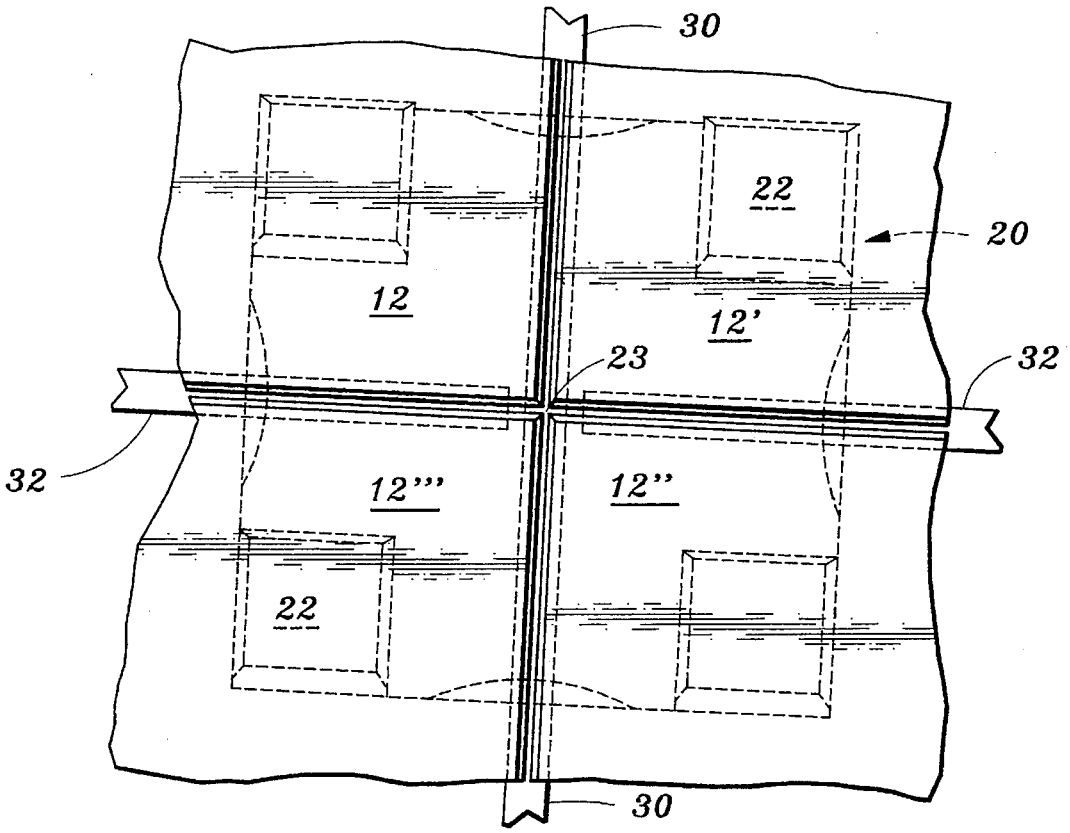
FIG. 8 is a top perspective close-up view of the junction of four dance sections.

FIG. 8 is further illustrative of the interconnection of adjacent dance sections as per FIG. 5. Here four sections are seen to be interlocked on a main connector plate 20 at the center point 23. The build-up strips are not visible in this view.

As mentioned earlier, each dance section comprises a sheet of plywood typically ½ to 1" and preferably ¾" thick, with peripheral build-up strips of about ½ inch thick therebeneath. This makes the preferred dance section's dance surface about 1.25 inches above the surface of the rug, cement et cetera or wherever the floor of this invention is employed.

To facilitate entry onto the dance floor, and to avoid injury due to tripping because of the differences in elevation, transition members such as 40 are employed on preferably all four sides of the dance floor 10, but at least along the longer dimension. These transition members may range in cross section from triangular, to pentagonal.

Figure 9:
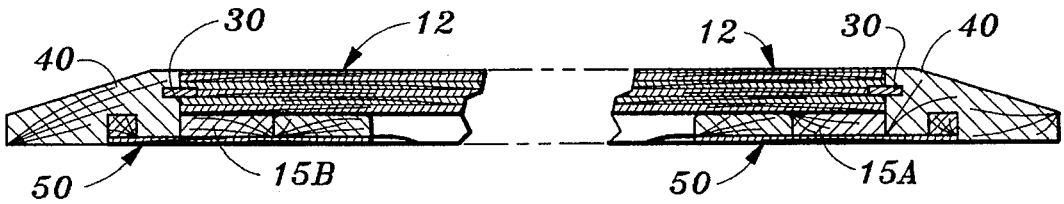
FIG. 9 is an elevational sectional view of a portable dance floor according to this invention.
Figure 10:
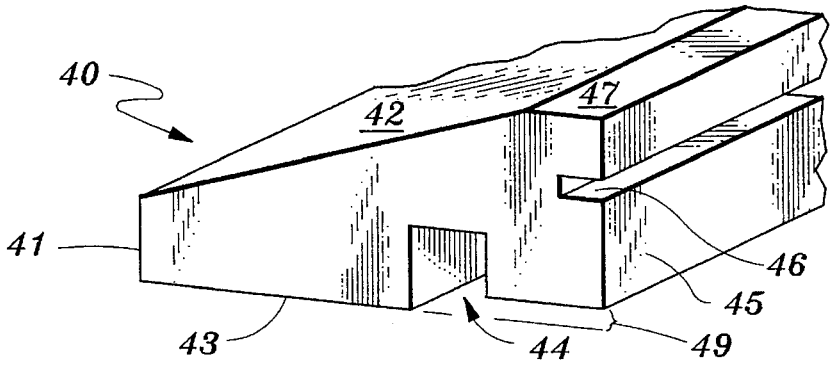
FIG. 10 is a perspective view of a transition member according to this invention.

Reference is now made to FIG. 10. The transition member 40 includes an inclined surface which terminates at its highest point at an elevation equal to that of the dance surface. Each transition member 40 is preferably of a pentagonal cross-section. Such member has a first very short vertical edge 41, which may range anywhere from about ⅛th inch to about ½ inch as may be desired. An inclined surface 42 adjoins the surface 41 preferably at about a 30 degree to a 45 degree angle. This inclined surface may extend the full width of the transition member, or can terminate at an upper horizontal surface 47 disposed at an elevation equal to the top surface of a dance section. Rear vertical wall 45 includes an inwardly directed half slot 46. Bottom wall 43 having an upwardly directed undercut 44 therein is normally disposed relative to the rear wall, and connects to the front wall 41 as well. The reader's attention is directed to the fact that the transition member 40 includes about an ⅛th inch thickness removed area along the rear thereof. This area is designated 49 and corresponds in fact to the thickness of the base plate of the transition connector plate, whereby when the base plate 51 is in position with its insert placed in undercut 44, bottom edge 43 will rest on the ground without rocking. This is brought out by reference to FIG. 9 as well.

A spline 30 is used to interconnect transition member 40 to its adjacent dance section as per FIG. 9. A transition connector 50 somewhat similar to main connector plate 20 is employed to interlock the transition member to adjacent dance section(s). See FIG. 12. Since transition members are preferably formed of injection molded plastic such as polyurethane elastomer, it is seen that these can be made in 16 foot, 8 foot and other lengths as may be desired which correspond to one, two or even more dance section widths or lengths.

Transition connector 50 includes a base 51 also of about ⅛th inch thick and a pair of spaced corner blocks 52 at two adjacent corners. Two of the corner blocks of a main connector plate are replaced by an upstanding elongated undercut insert 53 disposed between the other two corners of said base and sized to fit easily within the undercut 44. Reference is again made to FIG. 7 which shows the location for the usage of two transition connectors.

Dance floors of this invention are generally made in increments of 8 feet in length due to the size of 4×8 sheets of plywood, and increments of 4 feet in width. Thus the length will go 16, 24, 32, 40 feet et cetera while the width will be 8, 12, 16, 20, 24 et cetera. The typical dance floor and, particularly, those shown in this invention include at least 4 dance sections 4 feet×8 feet joined together. Oftentimes, however, the dance floors are much larger, such as 32 feet long, by 24 feet wide.

Discussion has already been set out about the use of a transition member to prevent people from tripping as they ascend onto the dance floor, from the carpet or concrete or other supporting surface. But as is seen in FIG. 10, the transition members 40 are linear and of 8 feet in length. While these can be used along both the length and width of the dance floor of this invention, there could be a hazard at the four outside corners of the dance floor both from the point of view of the requirement of a step up, be it ever so minor, and from the point of view of proper junction of the linear transition members 40 to the dance sections.

Figure 15:
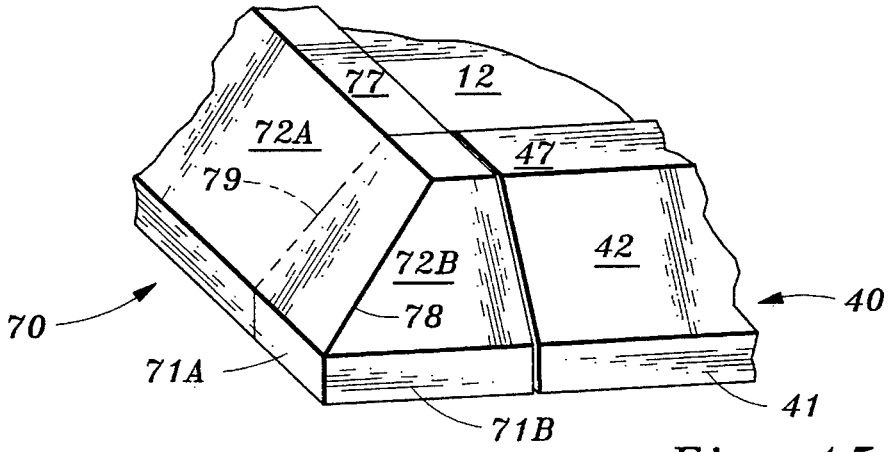
FIG. 15 is a perspective view of the special transition member utilized at an outside corner of this dance floor.

For these reasons, I prefer to employ a special transition member 70, seen in perspective in FIG. 15 to prevent injury at the four outside corners of a conventional rectangular dance floor. Special transition member 70 includes not one but two vertical front walls, 71A and 71B, and two inclined walls 72A, and 72B with one flat top wall 77. In other words, as can be seen, special transition member 70 wraps around the corner and includes a transition edge 78 from which the two inclined surfaces commence. Dotted line 79 is a mythical line to show the normal termination of a transition member to help the reader understand the extra extension along inclined surface 72A, which is equal to the depth of the flat surface and which extension then wraps around the 90° corner in FIG. 15 to form surface 72B.

Figure 16:
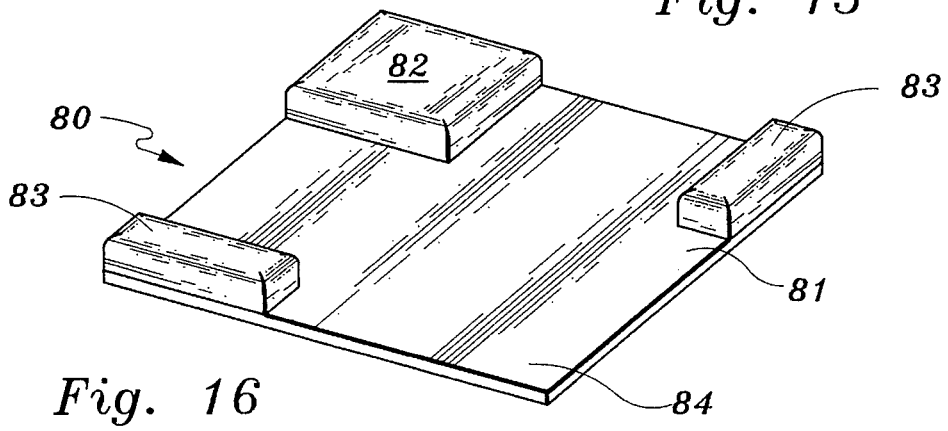
FIG. 16 is a perspective view of the special transition connector employed with the special transition member at an outside corner of the dance floor of this invention.

Special transition members 70 include a standard undercut 44 along the length thereof, up to dotted line 79 to accommodate the receipt of special transition connector 80 shown in perspective in FIG. 16. Member 70 also has a slot 46 of equal extension; both of which are not seen in these views. Here too, no edge notch similar to 28 of main connector plate 20 is shown. But the inclusion of same is within the scope of this invention. Since corner block 82 is similar to block 22, it preferably has chamfered or filleted upper edges.

Figure 14:
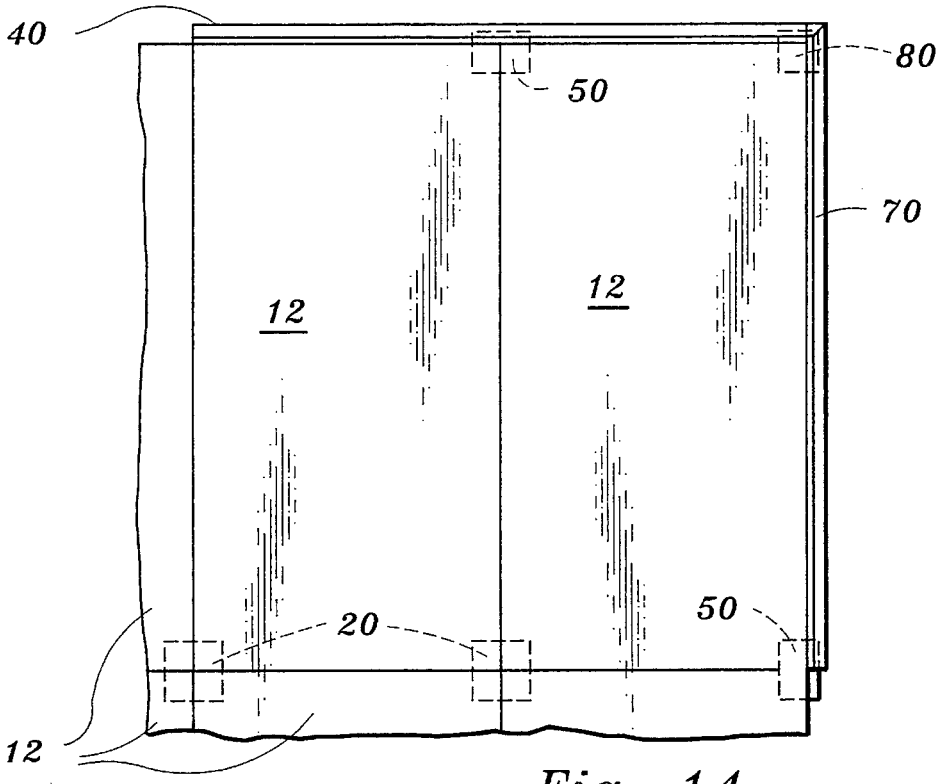
FIG. 14 is a top plan view of a portion of the portable dance floor of this invention; namely, that portion that includes an outside corner.

Reference is also made to FIG. 14 which illustrates an outside corner and which depicts the presence of both transition member 40 and special transition member 70.

In FIG. 16, special transition connector 80 is seen. It has a base 81, a corner block 82 of the same size and shape as corner block 52. But rather than have one undercut insert similar to insert 53, it has two partial inserts 83. These are designated partial inserts because they are disposed at diagonally opposite corners of the base 81 and extend only a short distance at 90 degrees apart along two edges of the base's upper surface. This allows the distance between imaginary line 79 and transition edge 78 and all of incline 72B to rest in the free space 84 corner of the special transition connector's base 81.

If one were to create a non-rectangular dance floor, of any configuration having an inside corner, it would be obvious to one of ordinary skill to modify the special transition member and the special transition connector just described to suit such a situation.

Figure 13:
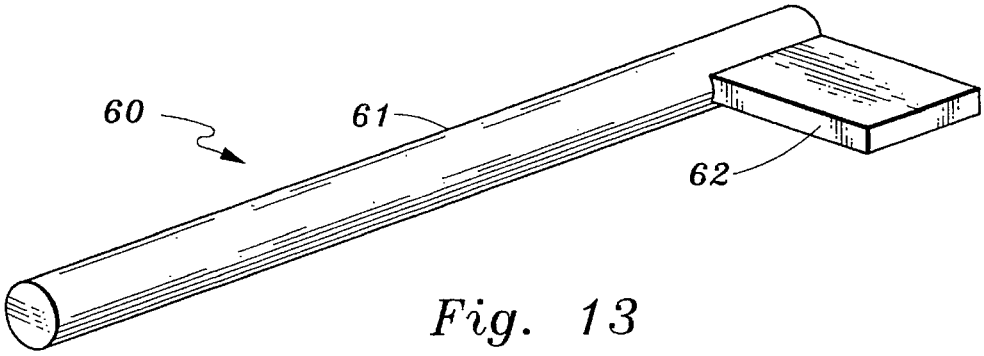
FIG. 13 is a perspective view of the tool utilized to disassemble the portable dance floor of this invention.

FIG. 13 illustrates a tool that is used to disassemble a dance floor 10 according to this invention after the band plays the last dance. After two workmen remove a transition member access can be had to the interface between adjoining dance sections and their respective transition connector, and later in time to the main connector plates.

Tool 60 includes a handle 61, of any of round, square or hexagonal cross section, to which is normally attached a flat bar segment 62. One places the handle along imaginary line 55 of the transition connector such that the flat bar segment 61, lies generally along imaginary line 54 of said connector as per FIG. 12. A slight rotational move of the handle 61 leftwardly causes the flat bar segment 62 to move upwardly to thereby release the build-up of a dance section from the connector plate for easy removal of the dance section by a workman. Similar lever action can be applied to other dance section to unlock their build-up strips from the confines of additional main connector plates.

It is seen that I have provided an easy to assemble portable dance floor, wherein the individual dance sections both interlock at a central point on a connector plate, and adjacent dance sections interconnect by a spline to form a smooth dance floor of a unitary height. Tripping is inhibited by the provision of transition members to each of the dance sections of the dance floor from the standard floor or rug of the room.

It is seen that the portable dance floors of this invention can be made in rectangular, square, H, L or other configurations as may be suitable to the locus where the dance floor is to be utilized.

While plywood is recommended for the dance substrate of the dance section, obviously individual planks such as are used for a hardwood floor can be used as well but at higher cost and greater weight.

It is also to be understood that while only one terminus is shown on any particular buildup strip, be it short or long, in fact each build-up strip has two termini at opposite ends thereof.

Typical dimensions for a main connector plate are 6.375 inches for length and width with the individual spaced blocks being about 1.5"×1.5". Filleting of the blocks is also recommended for ease of assembly of the dance floor.

By raising the dance substrate off of the ground level, I am able to achieve the resiliency in the dance surface desired by most dancers.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. An improved portable dance floor apparatus comprising a plurality of interconnected and interlocked dance sections, each of which dance sections comprises:

a. a dance substrate having a dance surface and an underside and having a plurality of build-up strips on its underside around the periphery thereof, each of which build-up strips comprises an elongated generally rectangular portion having a bottom cutout section at each terminus;

b. a main connector plate disposed beneath at least two adjacent dance sections, each of which main connector plates has a base and four upstanding spaced blocks disposed one in each corner upon said base, whereby when positioned beneath said dance sections, each of the spaced blocks fit behind two normally disposed build-up strips such that movement of any one dance section is impeded by any one block of said main connector plate and by the presence of an adjacent dance section, wherein each dance substrate has an inwardly directed half slot along one dimension's thickness, and further wherein a V-groove is formed between any two adjacent dance sections at the dance surface along one dimension thereof and additionally including a reinforcing strip of an elevation equal to the build-up strips, disposed in one direction on the underside of the dance substrate.

2. In the apparatus of claim 1 further including a spline disposed within the slot formed of two opposed half slots.

3. In the apparatus of claim 1 wherein the dance substrate is plywood and the build-up strips are of Baltic birch wood.

4. In the apparatus of claim 1 further including at least one transition member connected to abutting dance sections by a transition connector to prevent injury.

5. In the apparatus of claim 4 wherein the transition member includes an inclined surface which terminates at its highest point at an elevation equal to that of the dance surface.

6. In the apparatus of claim 5 wherein the inclined surface terminates at a flat surface also disposed at an elevation equal to that of the dance surface.

7. In the apparatus of claim 1 wherein each spaced block is filleted on all of its upper edges.

8. In the apparatus of claim 1 wherein the reinforcing strip runs along the length of each dance section at about the midpoint of the width thereof.

9. An improved portable dance floor comprising a plurality of interconnected and interlocked dance sections, each of which dance sections comprises:

a. a dance substrate having a dance surface and an underside and having a plurality of build-up strips on its underside around the periphery thereof, each of which build-up strips comprises an elongated generally rectangular portion having a bottom cutout section at each terminus;

b. a main connector plate disposed beneath at least two adjacent dance sections, each of which main connector plates has a base and four upstanding spaced blocks disposed one in each corner upon said base, whereby when positioned beneath said dance sections, each of the spaced blocks fit behind two normally disposed build-up strips such that movement of any one dance section is impeded by any one block of said main connector plate and by the presence of an adjacent dance section, further including at least one transition member connected to abutting dance sections by a transition connector to prevent injury, and wherein each transition connector includes a base having two spaced blocks at two adjacent corners thereof and an upstanding elongated insert spaced from said blocks between the other two corners thereof.

10. An improved portable dance floor apparatus comprising a plurality of interconnected and interlocked rectangular dance sections, each of which dance sections comprises:

a. a dance substrate having a dance surface and an underside and having a plurality of build-up strips on its underside around the periphery thereof, each of which build-up strips comprises an elongated generally rectangular portion having a bottom cutout section at each terminus and wherein each dance substrate has an inwardly directed half slot along the width's thickness;

b. a main connector plate disposed beneath at least two adjacent dance sections, each of which main connector plates has a base and four upstanding spaced blocks disposed one in each corner upon said base, c. a spline disposed within the slot formed of two opposed half slots;

whereby when positioned beneath said dance sections, each of the spaced blocks fit behind two normally disposed build-up strips such that movement of any one dance section is impeded by any one block of said main connector plate and by the presence of an adjacent dance section wherein a V-groove is formed between any two adjacent dance sections at the dance surface along one dimension thereof and further including a reinforcing strip of an elevation equal to the build-up strips, disposed along the length on the underside of the dance substrate.

11. In the apparatus of claim 10 further including at least one transition member connected to abutting dance sections by a transition connector to prevent injury due to any difference in elevation between the dance surface and ground level.

12. In the apparatus of claim 11 wherein the transition member includes an inclined surface which terminates at its highest point at an elevation equal to that of the dance surface.

13. In the apparatus of claim 10 wherein at least 4 dance sections are interconnected and interlocked to form a portable dance floor, and transition members are disposed along two sides of said dance floor.

14. In the apparatus of claim 13 wherein the dance surface of each substrate is plywood and the build-up sections are constructed of Baltic birch wood.

15. An improved portable dance floor apparatus comprising a plurality of interconnected and interlocked rectangular dance sections, each of which dance sections comprises:

(a) a dance substrate having a dance surface and an underside and having a plurality of build-up strips on its underside around the periphery thereof, each of which build-up strips comprises an elongated generally rectangular portion having a bottom cutout section at each terminus and wherein each dance substrate has an inwardly directed half slot along the smaller dimension's thickness;

b. a main connector plate disposed beneath at least two adjacent dance sections, each of which main connector plates has a base and four upstanding spaced blocks disposed one in each corner upon said base, c. a spline disposed within the slot formed of two opposed half slots;

whereby when positioned beneath said dance sections, each of the spaced blocks fit behind two normally disposed build-up strips such that movement of any one dance section is impeded by any one block of said main connector plate and by the presence of an adjacent dance section, wherein a V-groove is formed between any two adjacent dance sections at the dance surface along one dimension thereof;

wherein four special transition members are employed along the two long dimension sides, one at each of the four corners of the portable dance floor; each of which is retained in place by a special transition connector.

16. In the apparatus of claim 15 wherein the dance substrate is plywood and the build-up strips are of Baltic birch wood.

* * * * *